US007062016B2

(12) United States Patent
Kawabuchi

(10) Patent No.: US 7,062,016 B2
(45) Date of Patent: Jun. 13, 2006

(54) THERMAL GENERATOR ASSEMBLY, X-RAY IMAGING SYSTEM, AND X-RAY APPARATUS OVERHEAT PREVENTING METHOD

(75) Inventor: Yuko Kawabuchi, Tokyo (JP)

(73) Assignee: GE Medical Systems Global Technology Company, Waukesha, WI (US)

( * ) Notice: Subject to any disclaimer, the term of this patent is extended or adjusted under 35 U.S.C. 154(b) by 0 days.

(21) Appl. No.: 10/960,663

(22) Filed: Oct. 7, 2004

(65) Prior Publication Data

US 2005/0078795 A1 Apr. 14, 2005

(30) Foreign Application Priority Data

Oct. 9, 2003 (JP) ..... 2003-350688

(51) Int. Cl.
*H05G 1/26* (2006.01)

(52) U.S. Cl. ..... 378/118; 378/199; 378/127

(58) Field of Classification Search ..... 378/118, 378/127, 141, 199, 117
See application file for complete search history.

(56) References Cited

U.S. PATENT DOCUMENTS 3,770,963 A 11/1973 Vandervelden et al.
3,842,280 A 10/1974 Herrick
3,974,385 A 8/1976 Grim
4,297,638 A 10/1981 LaFrance
4,311,913 A 1/1982 Resnick et al.
4,386,320 A 5/1983 Lafrance
4,918,714 A 4/1990 Adamski et al.
4,991,193 A 2/1991 Cecil et al.
5,008,916 A 4/1991 Le Guen
6,449,337 B1 * 9/2002 Honda et al. ..... 378/117
6,487,463 B1 * 11/2002 Stepp, III ..... 700/79

FOREIGN PATENT DOCUMENTS

JP 2001-231775 8/2001

* cited by examiner

*Primary Examiner*—David V. Bruce
*Assistant Examiner*—Hoon Song
(74) *Attorney, Agent, or Firm*—Carl B. Horton, Esq.; Armstrong Teasdale LLP

(57) ABSTRACT

A method for preventing overheating of an X-ray apparatus. The method includes controlling an X-ray tube and an X-ray detector which are opposed to each other with a subject between them so as to acquire projection data concerning the subject, estimating quantities of heat dissipated from the X-ray tube and a high-voltage generator that supplies power to the X-ray tube during the acquisition, and optimizing a control parameter, which is used to control the X-ray tube and the high-voltage generator, on the basis of estimates of the quantities of heat dissipated during the acquisition so as to prevent overheat of the X-ray tube and the high-voltage generator.

19 Claims, 5 Drawing Sheets

THERMAL GENERATOR ASSEMBLY, X-RAY IMAGING SYSTEM, AND X-RAY APPARATUS OVERHEAT PREVENTING METHOD

CROSS REFERENCE TO RELATED APPLICATIONS

This application claims the benefit of Japanese Application No. 2003-350688 filed Oct. 9, 2003.

BACKGROUND OF THE INVENTION

The present invention relates to a thermal generator assembly including heat dissipators such as an X-ray tube and a high-voltage generator that supplies power to the X-ray tube, an X-ray imaging system, and an X-ray apparatus overheat preventing method.

In recent years, X-ray imaging systems including an X-ray computed-tomography (CT) system have employed a high-power X-ray tube. Consequently, a large exposure is used to produce high-quality images or continuous X-irradiation is performed to acquire image information from a wider radiographic range.

On the other hand, as more and more X-ray tubes generate higher power, a quantity of heat dissipated from an X-ray tube has increased. Along with the heat dissipation, the X-ray tube may be overheated and deteriorated. In order to prevent deterioration, before radiography is performed, a quantity of heat dissipated from the X-ray tube for the radiography is estimated. If the quantity of dissipated heat exceeds a permissible range, radiography is stopped or the conditions for radiography are reviewed (refer to, for example, Patent Document 1).

[Patent Document 1] Japanese Unexamined Patent Application Publication No. 2001-231775 (P.2 to P.3, FIG. 6 and FIG. 7).

However, according to the foregoing background technology, a quantity of heat dissipated from a high-voltage generator that supplies power to an X-ray tube is not estimated. Therefore, the conditions for radiography are not reviewed based on the information on the quantity of dissipated heat. In other words, every time high-power radiography is repeated, the high-voltage generator is overheated to deteriorate or have the reliability thereof degraded.

In particular, the power generated by an X-ray tube has drastically increased in recent years. A load the high-voltage generator incurs in supplying power to the X-ray tube has also increased. These increases become factors causing the X-ray high-voltage generator to overheat and to eventually deteriorate or have the reliability thereof degraded.

Consequently, it is important how to realize a thermal generator assembly that optimizes quantities of heat dissipated from an X-ray tube and a high-voltage generator which supplies power to the X-ray tube, an X-ray imaging system, and an X-ray apparatus overheat preventing method.

SUMMARY OF THE INVENTION

Therefore, an object of the present invention is to provide a thermal generator assembly that optimizes quantities of heat dissipated from an X-ray tube and a high-voltage generator which supplies power to the X-ray tube, an X-ray imaging system, and an X-ray apparatus overheat preventing method.

In order to solve the above problem and accomplish the object, according to the first aspect of the present invention, there is provided a thermal generator assembly comprising: a plurality of heat dissipators that dissipates heat; a voltage generator that supplies power to the heat dissipators; estimating means for estimating quantities of heat dissipated from the heat dissipators and from the voltage generator; and a control processing unit for performing optimization on the basis of estimates of the quantities of dissipated heat so as to prevent overheat of the heat dissipators and the voltage generator.

According to the first aspect of the present invention, the plurality of heat dissipators dissipates heat, and the voltage generator supplies power to the heat dissipators. The estimating means estimates the quantities of heat dissipated from the heat dissipators and from the voltage generator. Based on the estimates of the quantities of dissipated heat, the control processing unit performs optimization so as to prevent overheat of the heat dissipators and the voltage generator. Even if one of the heat dissipators and the voltage generator overheats, the quantities of dissipated heat are estimated, and overheat is prevented based on the estimates. Eventually, deterioration of the heat dissipators and voltage generator is prevented, and highly reliably operation is ensured.

Moreover, according to the second aspect of the present invention, there is provided a thermal generator assembly in which when the estimates exceed permissible ranges of values of the overheat, the control processing unit optimizes a control parameter, which is used to control the power, so that the estimates of the quantities of heat dissipated from the heat dissipators and voltage generator will fall within the permissible ranges if the estimates exceed the permissible range of the overheat.

According to the second aspect of the present invention, even if one of the heat dissipators and voltage generator overheats, since the quantities of dissipated heat are estimated, the control parameter is optimized in advance. Consequently, overheat is prevented.

According to the third aspect of the present invention, there is provided an X-ray imaging system comprising: an X-ray tube that generates an X-ray beam; a high-voltage generator that supplies power, which is needed to generate the X-ray beam, to the X-ray tube; an X-ray detector that detects the X-ray beam; a data acquisition unit that controls the X-ray tube and X-ray detector which are opposed to each other with a subject between them so as to acquire projection data concerning the subject; estimating means for estimating quantities of heat dissipated from the X-ray tube and the high-voltage generator during the acquisition; and a control processing unit that optimizes a control parameter, which is used to control the X-ray tube and the high-voltage generator, on the basis of estimates of the quantities of heat dissipated during the acquisition so as to prevent overheat of the X-ray tube and the high-voltage generator.

According to the third aspect of the present invention, the X-ray tube generates an X-ray beam, and the high-voltage generator supplies power, which is needed to generate the X-ray beam, to the X-ray tube. The X-ray detector detects the X-ray beam. The data acquisition unit acquires projection data concerning a subject from the X-ray tube and X-ray detector that are opposed to each other with the subject between them. The estimating means estimate the quantities of heat dissipated from the X-ray tube and high-voltage generator during acquisition. The control processing unit optimizes a control parameter, which is used to control the X-ray tube and high-voltage generator, on the basis of the estimates of the quantities of heat dissipated during acquisition so as to prevent overheat of the X-ray tube and high-voltage generator. Consequently, even if one of the X-ray tube and high-voltage generator overheats, since the quantities of dissipated heat are estimated, the control parameter is optimized in advance in order to prevent overheat. Eventually, deterioration of the X-ray tube and high-voltage generator is prevented, and highly reliable radiography is ensured.

Moreover, an X-ray imaging system in accordance with the fourth aspect of the present invention is an X-ray CT system.

According to the fourth aspect of the present invention, tomographic images are produced through image reconstruction performed based on projection data.

An X-ray imaging system in accordance with the fifth aspect of the present invention uses the control processing unit to disable acquisition when the estimates exceed the permissible ranges of values of the overheat.

According to the fifth aspect of the present invention, when the estimates exceed the permissible ranges, data acquisition is not performed in order to prevent deterioration or breakdown of the X-ray tube and high-voltage generator.

An X-ray imaging system in accordance with the sixth aspect of the present invention uses the control processing unit to perform optimization at a step preceding a step of acquisition when the quantities of dissipated heat exceed the permissible ranges of values of the overheat.

According to the sixth aspect of the present invention, an optimized control parameter is obtained prior to acquisition.

In an X-ray imaging system in accordance with the seventh aspect of the present invention, when the estimates are expressed with functions of the control parameter, inverse functions of the functions or binary search is used in the optimization to calculate a control parameter that causes the estimates to agree with upper limits of the permissible ranges.

According to the seventh aspect, the optimal value of the control parameter can be calculated quickly and easily.

In an X-ray imaging system in accordance with the eighth aspect of the present invention, the control parameter is at least one of a tube current and a tube voltage that are supplied from the high-voltage generator to the X-ray tube.

According to the eighth aspect of the present invention, the quantity of heat dissipated from the X-ray tube is controlled with an increase or decrease in a tube current or a tube voltage.

In an X-ray imaging system in accordance with the ninth aspect of the present invention, the control parameter is a cooling time during which the tube current that is supplied intermittently does not flow.

According to the ninth aspect of the present invention, the quantities of heat dissipated from the X-ray tube and high-voltage generator are controlled with the length of the cooling time.

In an X-ray imaging system in accordance with the tenth aspect of the present invention, the control parameter is a scan time elapsing from a start of the acquisition to an end thereof.

According to the tenth aspect of the present invention, the quantities of heat dissipated from the X-ray tube and high-voltage generator are controlled with the length of the scan time.

An X-ray imaging system in accordance with the eleventh aspect of the present invention further comprises display means on which information related to the acquisition is displayed.

According to the eleventh aspect of the present invention, the display means enable an operator to discern acquisition-related information.

In an X-ray imaging system in accordance with the twelfth aspect, when the acquisition is disabled, information that acquisition is disabled is displayed on the display means.

According to the twelfth aspect of the present invention, an operator can discern the acquisition-disabled state of the X-ray imaging system.

In an X-ray imaging system in accordance with the thirteenth aspect, a value of the optimized control parameter is displayed on the display means.

According to the thirteenth aspect of the present invention, an operator checks the validity of the optimized parameter.

An X-ray imaging system in accordance with the fourteenth aspect further comprises operating means for use in entering the acquisition-related information.

According to the fourteenth aspect, the operating means are used to enter acquisition-related information. An operator can determine various settings.

In an X-ray imaging system in accordance with the fifteenth aspect of the present invention, the operating means comprise selecting means that are used to select a control parameter for the optimization.

According to the fifteenth aspect of the present invention, the selecting means included in the operating means are used to select a control parameter for optimization. An operator's most preferable control parameter can be used for optimization.

In an X-ray imaging system in accordance with the sixteenth aspect of the present invention, the estimating means estimate the quantity of heat dissipated from the data acquisition unit.

According to the sixteenth aspect of the present invention, the quantity of heat dissipated from the data acquisition unit is recognized in advance.

In an X-ray imaging system in accordance with the seventeenth aspect of the present invention, the control processing unit performs optimization on the basis of the estimate of the quantity of dissipated heat so as to prevent overheat of the data acquisition unit.

According to the seventeenth aspect of the present invention, the quantity of heat dissipated from the data acquisition unit is determined so that overheat will not occur.

In an X-ray imaging system in accordance with the eighteenth aspect of the present invention, the estimating means and control processing unit adopt a temperature as a physical quantity indicating the quantity of dissipated heat.

According to the eighteenth aspect of the present invention, a rise in a temperature caused by heat dissipation is used as an index to verify overheat and perform optimization.

An X-ray apparatus overheat preventing method in accordance with the nineteenth aspect of the present invention comprises the steps of: controlling an X-ray tube and an X-ray detector which are opposed to each other with a subject between them so as to acquire projection data concerning the subject; estimating quantities of heat dissipated from the X-ray tube and a high-voltage generator that supplies power to the X-ray tube during the acquisition; and optimizing a control parameter, which is used to control the X-ray tube and high-voltage generator, on the basis of estimates of the quantities of heat dissipated during the acquisition so as to prevent overheat of the X-ray tube and high-voltage generator.

According to the nineteenth aspect of the present invention, even if either of the X-ray tube and high-voltage generator overheats, since the quantities of dissipated heat are estimated, the control parameter is optimized in advance in order to prevent overheat. Eventually, deterioration of the X-ray tube and high-voltage generator is prevented, and highly reliable radiography is ensured.

As described above, according to the present invention, even if one of a heat dissipator such as an X-ray tube and a voltage generator such as a high-voltage generator overheats, since the quantities of heat dissipated from the heat dissipator and voltage generator are estimated in order to optimize a control parameter in advance, overheat of the heat dissipator and voltage generator is prevented. Eventually, deterioration of the X-ray tube and high-voltage generator is prevented, and highly reliable radiography is ensured.

Further objects and advantages of the present invention will be apparent from the following description of the preferred embodiments of the invention as illustrated in the accompanying drawings.

DETAILED DESCRIPTION OF THE INVENTION

Referring to the appended drawings, the best mode of an X-ray imaging system in accordance with the present invention will be described below.

Figure 1:
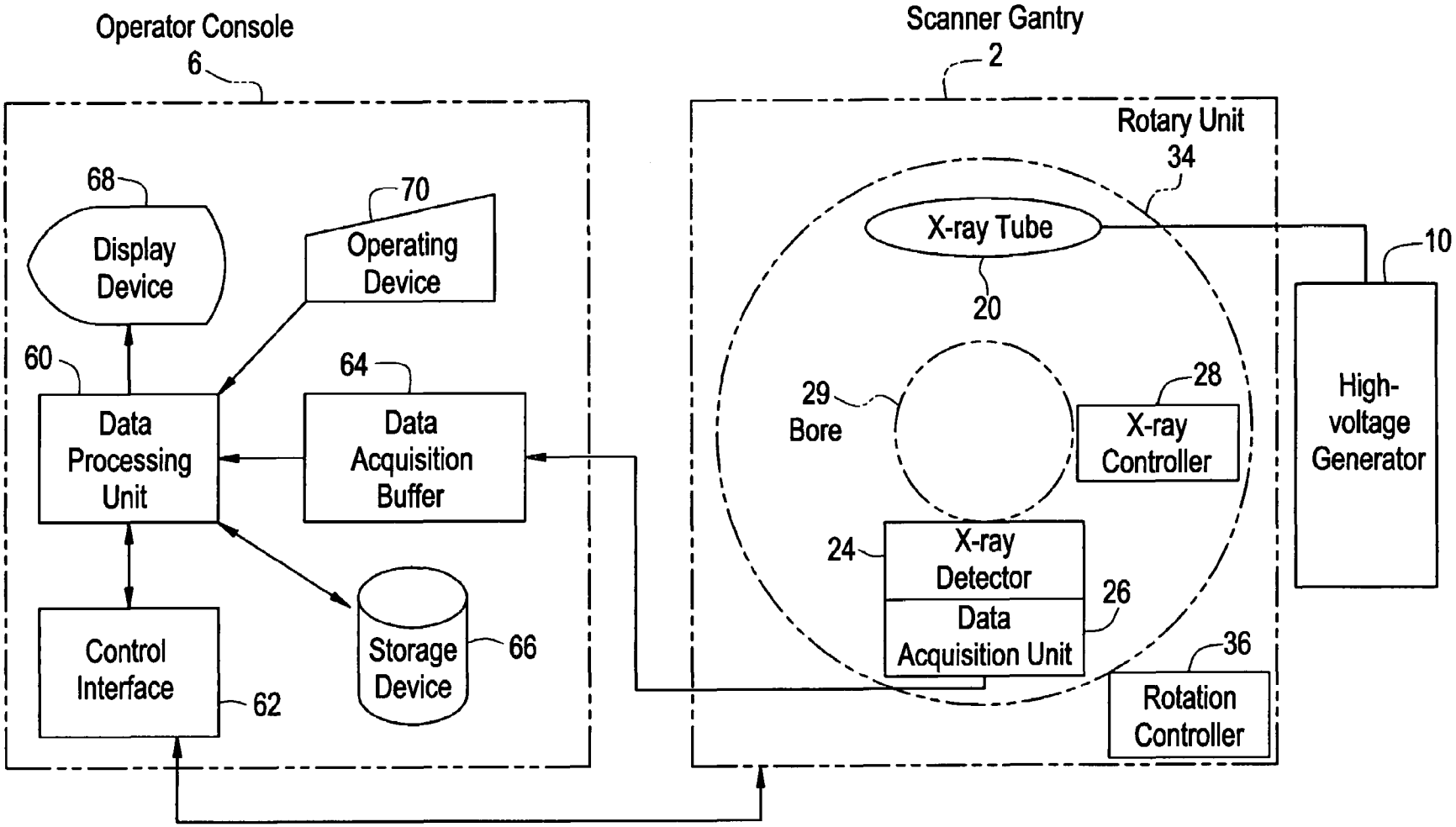
FIG. 1 is a block diagram showing the overall configuration of an X-ray imaging system.

To begin with, a description will be made of the overall configuration of an X-ray CT system that is an example of the X-ray imaging system in accordance with an embodiment of the present invention. FIG. 1 is a block diagram showing the X-ray CT system. As shown in FIG. 1, the X-ray CT system comprises a scanner gantry 2, an operator console 6, and a high-voltage generator 10.

The scanner gantry 2 includes an X-ray tube 20. The X-ray tube 20 serves as a heat dissipator. X-rays that are not shown and radiated from the X-ray tube 20 are recomposed into, for example, a conical X-ray beam by a collimator, and then radiated to an X-ray detector 24.

The high-voltage generator 10 is a voltage generator that applies a high voltage to the X-ray tube 20. Herein, the high-voltage generator 10 applies a voltage, which generally ranges from 120 kV to 140 kV and brings about 8 to 9 HU (heat unit), to the X-ray tube 20.

The X-ray detector 24 includes a plurality of X-ray detection elements arrayed two-dimensionally in a direction in which the conical X-ray beam spreads. In other words, the X-ray detector 24 is a multi-channel detector having the plurality of X-ray detection elements set in array.

The X-ray detector 24 has an X-ray incidence surface curved like a cylindrical concave surface as a whole. The X-ray detector 24 is formed with a combination of, for example, scintillators and photodiodes. Alternatively, the X-ray detector 24 may comprise semiconductor X-ray detection elements that utilize cadmium telluride (CdTe) or ionization chamber type X-ray detection elements that utilize xenon gas. The X-ray tube 20, collimator, and X-ray detector 24 constitute an X-irradiation/detection assembly.

A data acquisition unit 26 is connected to the X-ray detector 24. The data acquisition unit 26 acquires detection data from each of the X-ray detection elements constituting the X-ray detector 24. An X-ray controller 28 controls X-irradiation from the X-ray tube 20. Connection between the X-ray tube 20 and X-ray controller 28 and connection between the X-ray controller 28 and high-voltage generator 10 are not illustrated.

The foregoing components starting with the X-ray tube and ending with the X-ray controller 28 are incorporated in a rotary unit 34 of the scanner gantry 2. A subject or a phantom lies down on a cradle in a bore 29 formed in the center of the rotary unit 34. The rotary unit 34 rotates while being controlled by a rotation controller 36, and shoots X-rays from the X-ray tube 20. The X-ray detector 24 detects X-rays transmitted by the subject or phantom as each view of projection data. The illustration of the connective relationship between the rotary unit 34 and rotation controller 36 will be omitted.

The operator console 6 includes a control processing unit 60. The control processing unit 60 is formed with, for example, a computer. A control interface 62 is connected to the control processing unit 60. Furthermore, the scanner gantry 2 is connected to the control interface 62. The control processing unit 60 controls the scanner gantry 2 via the control interface 62.

The data acquisition unit 26, X-ray controller 28, and rotation controller 36 incorporated in the scanner gantry 2 are controlled via the control interface 62. The illustration of the connections of these components to the control interface 62 will be omitted.

A display device 68 and an operating device 70 are connected to the control processing unit 60. Tomographic images and other information provided by the control processing unit 60 are displayed on the display device 68. An operator handles the operating device 70 so as to enter scan parameters, various directives, or any other information that is transferred to the control processing unit 60. The operator uses the display device 68 and operating device 70 to interactively operate the X-ray CT system. Incidentally, the scanner gantry 2 and operator console 6 radiographs the subject or phantom so as to produce tomographic images.

Herein, the control processing unit 60 produces control parameters, which are used to control the scanner gantry 2 and high-voltage generator 10, from the scan parameters entered by the operator. The control parameters are transmitted to the respective components incorporated in the scanner gantry 2 via the control interface 62, whereby radiography, that is, scanning is performed. The control processing unit 60 includes an estimating means that infers overheat of the X-ray tube 20 and high-voltage generator 10 from the produced control parameters, and an optimizing means that optimizes the control parameters.

The control processing unit 60 is connected to a data acquisition buffer 64. The data acquisition buffer 64 is connected to the data acquisition unit 26 incorporated in the scanner gantry 2. Projection data acquired by the data acquisition unit 26 is transferred to the control processing unit 60.

The control processing unit 60 uses a transmitted X-ray signal, that is, projection data received via the data acquisition buffer 64 to reconstruct images. A storage device 66 is also connected to the control processing unit 60. Projection data held in the data acquisition buffer 64, reconstructed tomographic images, and programs that realize the features of the X-ray CT system are stored in the storage device 66.

Figure 2:
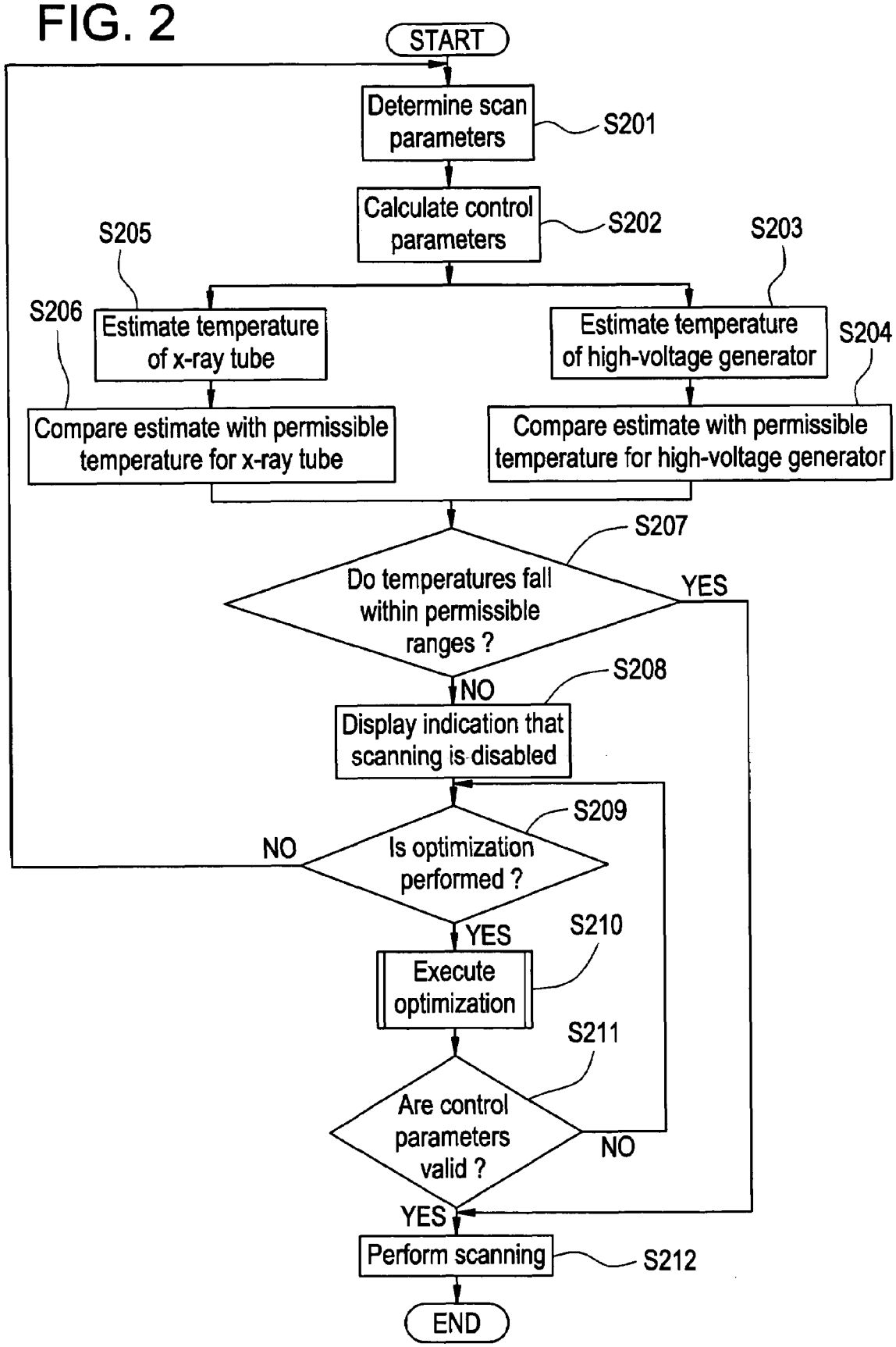
FIG. 2 is a flowchart describing actions to be performed by a control processing unit included in an embodiment.

Next, the actions to be performed in the control processing unit 60 will be described. FIG. 2 is a flowchart describing the actions to be performed in a control processing unit included in the present invention. First, an operator determines scan parameters using the operating device 70 (step S201). As the scan parameters, a scanned range, the number of times of slicing, a slice thickness, a scan mode, and a matrix size for image reconstruction are determined.

Thereafter, the control processing unit 60 calculates control parameters on the basis of the determined scan parameters (step S202). At this time, the control parameters based on which the scanner gantry is controlled, especially, a tube voltage, a tube current, a scan time, a tube cooling time, the number of times of irradiation, and other parameters are calculated.

Thereafter, the control processing unit 60 estimates the temperatures T of the X-ray tube 20 and high-voltage generator 10 on the basis of the control parameters (step S203 to step S205). Herein, the temperature of, for example, the rotating anode of the X-ray tube 20 is estimated based on such control parameters as a tube voltage, a tube current, and an exposure time. The temperature is provided as a function expressed below:

T=f(tube current, tube voltage, scan time, etc.)

At the same time, the temperature T' of the high-voltage generator 10 that is the source of the tube voltage and tube current is estimated as a function g.

T' =g(tube current, tube voltage, scan time, etc.)

Incidentally, the function g of the temperature of the high-voltage generator 10 is different from the function f of the temperature of the X-ray tube 20. Thus, not only heat dissipation from the X-ray tube 20 that has been inferred in the past but also heat dissipation from the high-voltage generator 10 are inferred.

Thereafter, the control processing unit 60 compares the temperatures of the X-ray tube 20 and high-voltage generator 10, which are estimated at step S203 and step S205, with permissible temperatures that do not cause overheat (step S204 and step S206). The permissible temperatures are read into the control processing unit 60 in advance and regarded as properties inherent to the X-ray tube 20 and high-voltage generator 10 respectively. When the temperatures are exceeded, a fault or a breakdown occurs.

Thereafter, the control processing unit 60 verifies whether the temperatures compared at step S204 and S206 are equal to or lower than the permissible temperatures (step S207). If the both temperatures are equal to or lower than the permissible temperatures (in the affirmative at step S207), control is passed to step S212, and scanning is performed.

If the both temperatures are not equal to or lower than the permissible temperatures (in the negative at step S207), one of the temperatures exceeds the permissible temperature. An indication that scanning is disabled is displayed on the display device 68 (step S208). An operator then uses the optimizing means included in the control processing unit 60 to verify whether any of the control parameters should be optimized (step S209). If none of the control parameters is optimized (in the negative at step S209), control is passed to step S201. The scan parameters are redetermined.

Moreover, if the control parameters are optimized (in the affirmative at step S209), the control processing unit 60 uses the optimizing means to perform optimization (step S210). During the optimization, the control parameter values are changed or set to the largest values that cause the temperatures of the X-ray tube and high-voltage generator 10 to be equal to or lower than the permissible temperatures. The results are displayed on the display device 68. The optimization will be detailed later.

Thereafter, the operator verifies whether the optimized control parameter values are valid (step S211). If the parameter values are invalid (in the negative at step S211), control is passed to step S209. It is verified whether optimization is resumed. If the control parameter values are valid, scanning is performed in order to acquire projection data (step S212). This process is then terminated.

Figure 3:
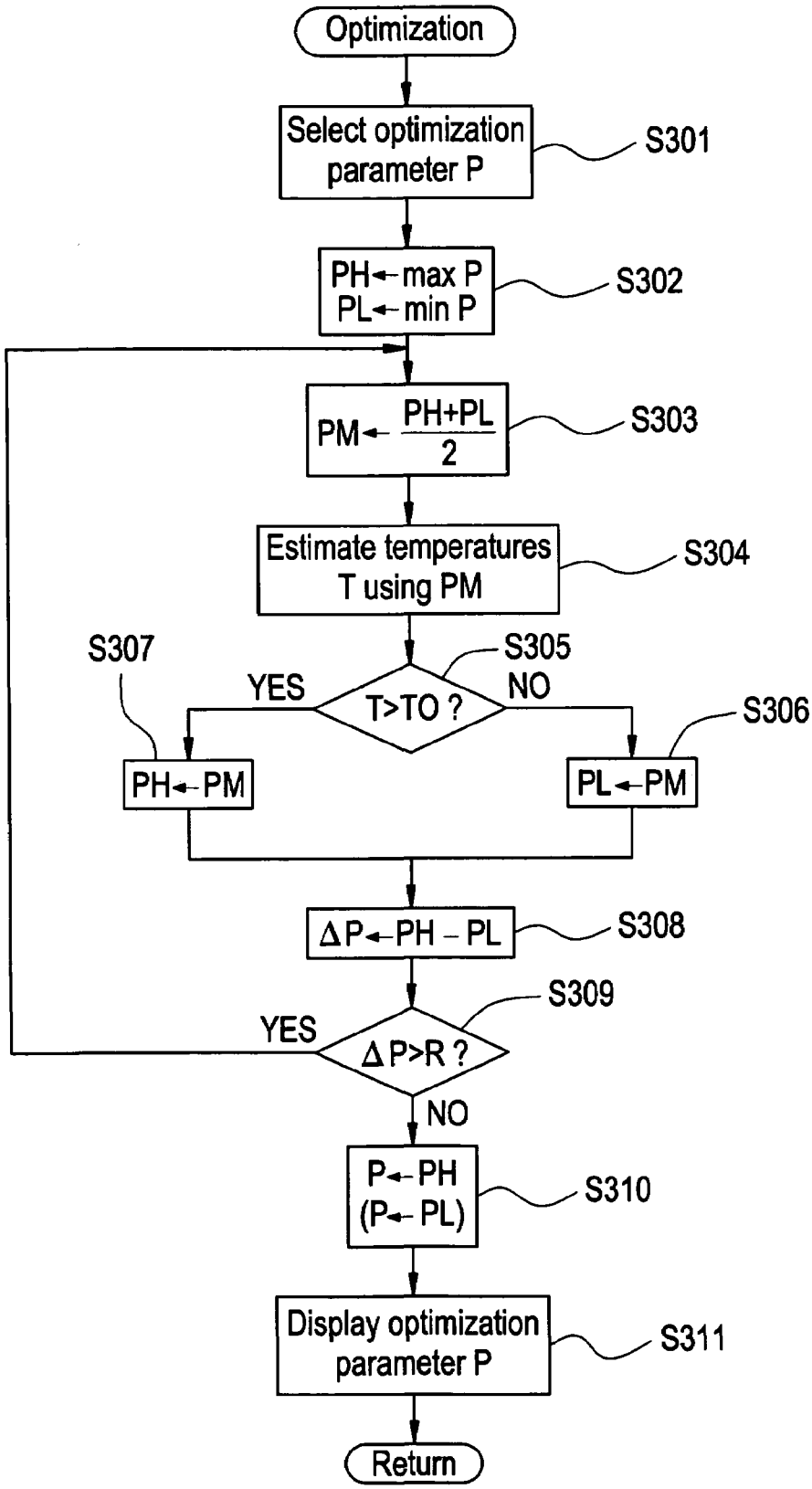
FIG. 3 is a flowchart describing actions to be performed by an optimizing means included in the present embodiment.

The optimization at step S210 will be described in conjunction with the flowchart of FIG. 3. FIG. 3 is a flowchart describing actions to be performed during optimization. Incidentally, the optimization is based on the binary search. First, an operator selects an optimization parameter P, which is used for optimization, from among the control parameters using the operating device 70 (step S301). As the optimization parameter P, for example, a tube current is selected. The maximum value of a range within which the optimization parameter P is variable shall be maxP, and the minimum value thereof shall be minP. The value maxP is assigned to a variable PH, and the value minP is assigned to a variable PL (step S302). Herein, the domain of variables between the variables PH and PL is sequentially diminished while always containing an optimal value. Finally, the variables PH and PL approximate to the optimal value. When the tube current is adopted as the optimization parameter for optimization, the value maxP indicates the maximum tube current supplied from the high-voltage generator 10, and the value minP indicates the minimum tube current supplied from the high-voltage generator 10.

Thereafter, the optimizing means assigns an intermediate value of the variables PH and PL, (PH+PL)/2, to a variable PM (step S303). Using the intermediate value PM, the temperatures T of the X-ray tube 20 and high-voltage generator 10 are estimated as the functions f and g employed at steps S203 and S205 described in FIG. 2 (step S304).

Thereafter, the optimizing means verifies whether both the estimated temperatures T fall below the permissible temperatures T0 that are the upper limits of permissible ranges (step S305). If the temperatures exceed the permissible temperatures (in the affirmative at step S305), the variable PM is assigned as a new maximum value to the variable PH (step S307). If the temperatures do not exceed the permissible temperatures (in the negative at step S305), the variable PM is assigned as a new minimum value to the variable PL (step S306).

Thereafter, the optimizing means assigns PH−PL to a difference AP between the variables PM and PL (step S308). The optimizing means then determines whether the difference ΔP exceeds a set value of a resolution R that is the smallest possible change (step S309). If the tube current is adopted as the optimization parameter, the resolution R is determined with a minimum range of set values of the tube current supplied from the high-voltage generator 10 or an energy resolution of X-rays. If the difference ΔP exceeds the resolution R (in the affirmative at step S309), control is passed to step S303. Processing from step S303 to step S308 is then performed. This processing is repeated until the difference ΔP becomes equal to or smaller than the resolution R.

Figure 4:
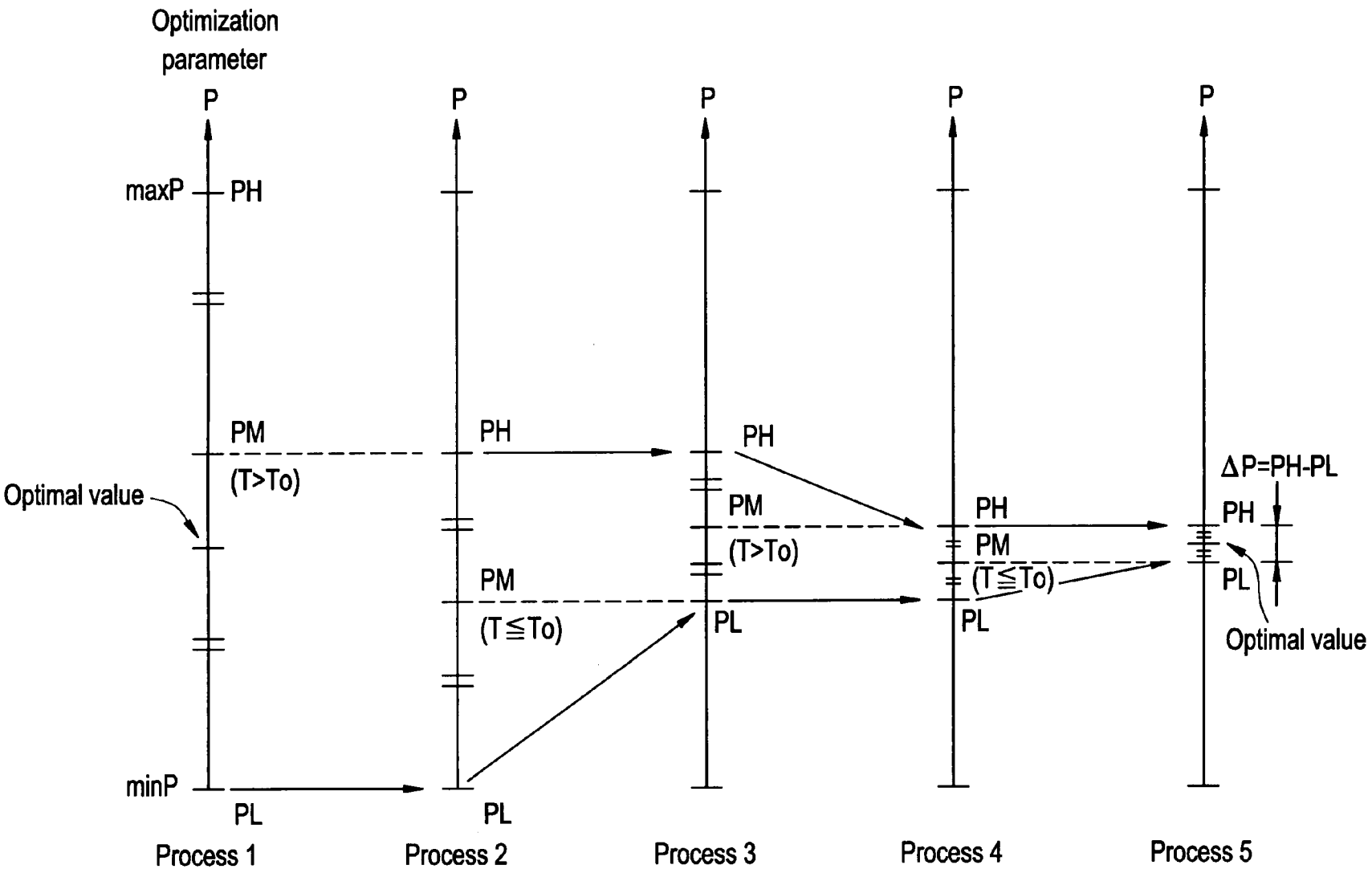
FIG. 4 shows a pattern indicating actions to be performed according to the binary search in the present embodiment.

FIG. 4 shows a pattern indicating a process for calculating an optimal value by repeating the processing from step S303 to step S308. Referring to FIG. 4, the process for calculating an optimal value for the optimization parameter P includes processes 1 to 5. At the first time, initialization is performed, and the temperatures T estimated using the PM value are higher than the permissible temperatures T0. Therefore, process 2, the PM value is used as a new PH value, and the same processing is performed. Every time the processing from step S303 to step S308 is repeated, the difference ΔP between the variable PM and variable PL is halved. The domain within which an optimal value is present is gradually narrowed.

Referring back to FIG. 3, if the difference ΔP does not exceeds the set value of the resolution R (in the negative at step S309), there is no meaning in repeating the processing from step S303 to step S308 so as to make the difference ΔP smaller. The optimizing means therefore adopts the variable PH or PL as the optimization parameter value P (step S310). The optimization parameter value P is then displayed on the display device 68 (step S311). Control is then passed to step 211 in FIG. 2.

As mentioned above, according to the present embodiment, the temperatures of the X-ray tube 20 and high-voltage generator 10 to be attained during scanning are estimated. If the temperatures exceed the permissible temperatures, it means that the temperatures may cause overheat. In this case, an indication that scanning is disabled is displayed. Furthermore, when the optimizing means is selected, an optimization parameter that is a tube current or a tube voltage is optimized according to the binary search and set to a value that causes the temperatures to fall below the permissible temperatures. Therefore, the X-ray tube and high-voltage generator will not overheat but operate with the temperatures thereof retained below the permissible temperatures. Deterioration of the X-ray tube 20 or high-voltage generator 10 is prevented. Eventually, highly reliable scanning can be ensured.

According to the present embodiment, the temperatures of the X-ray tube 20 and high-voltage generator 10 are controlled. Likewise, an accumulated quantity of heat or any other physical quantity relevant to heat dissipation may be adopted for control as well.

Figure 5A:
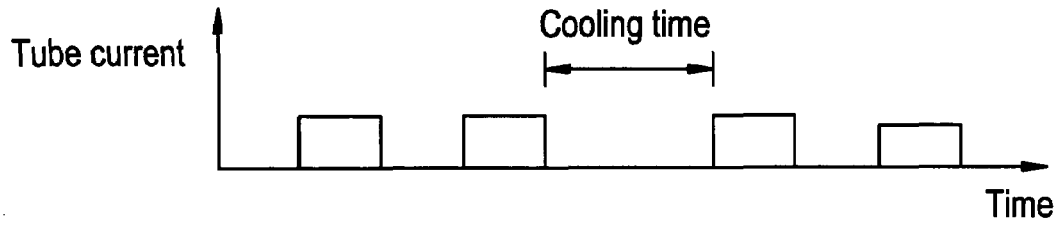
FIG. 5 indicates a cooling time required for an X-ray tube.
Figure 5B:
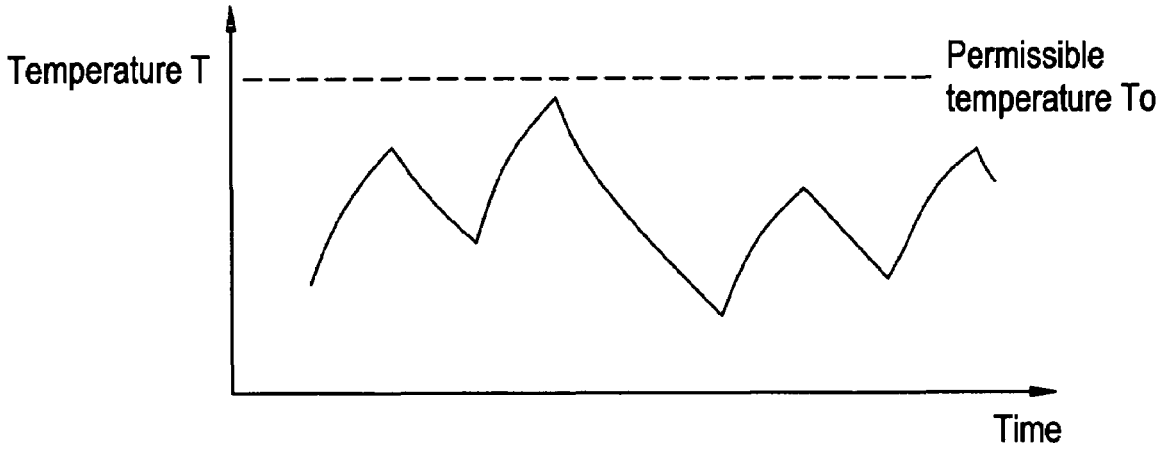

According to the present embodiment, the tube current of the X-ray tube is optimized. Likewise, the tube voltage may be adopted as an optimization parameter. Furthermore, the cooling time required for the X-ray tube 20 may be adopted as the optimization parameter. The cooling time refers to a time during which no tube current flows as indicated in FIG. 5. As the flow of the tube current into the X-ray tube 20 is, as indicated in FIG. 5(A), enabled or disabled, the temperature of the X-ray tube 20 rises or drops as indicated in FIG. 5(B). When the cooling time is set to a long time, the X-ray tube 20 is cooled so that the temperature of the X-ray tube 20 will be retained at the permissible temperature or lower. The longer the cooling time is, the lower the temperature is. Therefore, the steps S306 and S307 described in the flowchart of FIG. 3 are switched.

According to the present embodiment, optimization is performed using the binary search. Alternatively, an optimization parameter value may be determined or directly calculated as an inverse function of the function f or g. Otherwise, a high-order search may be adopted for fast search.

According to the present embodiment, the temperatures of the X-ray tube 20 and high-voltage generator 10 are estimated for optimization. Similarly, the temperature of a data acquisition system (DAS) including the data acquisition unit 26 that is a heat dissipator may be estimated for optimization.

Many widely different embodiments of the invention may be configured without departing from the spirit and the scope of the present invention. It should be understood that the present invention is not limited to the specific embodiments described in the specification, except as defined in the appended claims.

The invention claimed is:

1. A thermal generator assembly comprising:

a plurality of heat dissipators that dissipates heat;

a voltage generator that supplies power to said heat dissipators;

an estimating device for estimating quantities of heat dissipated from said heat dissipators and from said voltage generator configured to supply power to an X-ray tube; and a control processing device for performing optimization on the basis of estimates of the quantities of dissipated heat so as to prevent overheat of said heat dissipators and said voltage generator.

2. The thermal generator assembly according to claim 1, wherein when the estimates exceed permissible ranges of values of said overheat, said control processing device optimizes a control parameter, which is used to control said power, so that quantities of heat dissipated from said heat dissipators and said voltage generator will fall within the permissible ranges.

3. An X-ray imaging system comprising:

an X-ray tube that generates an X-ray beam;

a high-voltage generator that supplies power, which is needed to generate said X-ray beam, to said X-ray tube;

an X-ray detector that detects said X-ray beam;

a data acquisition device that controls said X-ray tube and said X-ray detector which are opposed to each other with a subject between them so as to acquire projection data concerning said subject;

an estimating device for estimating quantities of heat dissipated from said X-ray tube and from said high-voltage generator during said acquisition; and a control processing device that optimizes a control parameter, which is used to control said X-ray tube and said high-voltage generator, on the basis of estimates of the quantities of heat dissipated during said acquisition so as to prevent overheat of said X-ray tube and said high-voltage generator.

4. The X-ray imaging system according to claim 3, wherein said X-ray imaging system is an X-ray CT system.

5. The X-ray imaging system according to claim 3, wherein when the quantities of dissipated heat exceed permissible ranges of values of said overheat, said control processing device disables said acquisition in advance.

6. The X-ray imaging system according to claim 5, wherein when the acquisition is disabled, information that scanning is disabled is displayed on said display device.

7. The X-ray imaging system according to claim 3, wherein, when the quantities of dissipated heat exceed the permissible ranges of values of said overheat, said control processing device performs said optimization at a step preceding a step of said acquisition.

8. The X-ray imaging system according to claim 7, wherein when said estimates are expressed as functions of said control parameter, a binary search is used in said optimization to calculate a control parameter that causes the estimates to agree with upper limits of the permissible ranges.

9. The X-ray imaging system according to claim 8, wherein said control parameter is at least one of a tube current and a tube voltage that are supplied from said high-voltage generator to said X-ray tube.

10. The X-ray imaging system according to claim 8, wherein said control parameter is a cooling time during which said tube current that is supplied intermittently does not flow.

11. The X-ray imaging system according to claim 8, wherein said control parameter is a scan time elapsing from a start of said acquisition to an end thereof.

12. The X-ray imaging system according to claim 8, wherein a value of said optimized control parameter is displayed on said display device.

13. The X-ray imaging system according to claim 3, further comprising a display device on which information related to said acquisition is displayed.

14. The X-ray imaging system according to claim 3, further comprising an operating device for use in entering acquisition-related information configured to acquire the projection data.

15. The X-ray imaging system according to claim 14, wherein said operating device include a selecting device that are used to select a control parameter for said optimization.

16. The X-ray imaging system according to claim 3, wherein said estimating device estimate the quantity of heat dissipated from said data acquisition device.

17. The X-ray imaging system according to claim 16, wherein said control processing device performs optimization on the basis of the estimate of the quantity of dissipated heat so as to prevent overheat of said data acquisition device.

18. The X-ray imaging system according to claim 3, wherein said estimating device and said control processing device adopt a temperature as a physical quantity indicating said quantity of dissipated heat.

19. An X-ray apparatus overheat preventing method comprising the steps of:

controlling an X-ray tube and an X-ray detector which are opposed to each other with a subject between them so as to acquire projection data concerning the subject;

estimating quantities of heat dissipated from said X-ray tube and a high-voltage generator that supplies power to said X-ray tube during said acquisition; and optimizing a control parameter, which is used to control said X-ray tube and said high-voltage generator, on the basis of estimates of the quantities of heat dissipated during said acquisition so as to prevent overheat of said X-ray tube and said high-voltage generator.

* * * * *